US005845766A

United States Patent [19]

Sako et al.

[11] Patent Number: 5,845,766

[45] Date of Patent: Dec. 8, 1998

[54] MOVABLE CONTACT ELEMENT FOR PANEL SWITCH AND METHOD OF MANUFACTURING PANEL SWITCH WITH MOVABLE CONTACT ELEMENT

[75] Inventors: Koji Sako; Hiromichi Koyama, both of Katsuta-gun, Japan

[73] Assignee: Matsushita Electric Industrial Co., Ltd., Osaka, Japan

[21] Appl. No.: 843,942

[22] Filed: Apr. 17, 1997

[51] Int. Cl.[6] ..... H01H 11/00; H01H 13/70

[52] U.S. Cl. ..... 200/516; 29/622

[58] Field of Search ..... 29/622; 200/5 A, 200/512–517; 400/472, 490, 491, 491.2, 491.3, 495, 495.1

[56] References Cited

U.S. PATENT DOCUMENTS

| | | | |
|---|---|---|---|
| 4,033,030 | 7/1977 | Robinson et al. | 29/622 |
| 4,083,100 | 4/1978 | Flint et al. | 29/622 |
| 4,263,485 | 4/1981 | Corwin | 200/5 A |
| 4,463,234 | 7/1984 | Bennewitz | 200/159 B |
| 5,224,591 | 7/1993 | Santo et al. | 200/516 |

*Primary Examiner*—Michael A. Friedhofer
*Attorney, Agent, or Firm*—McDermott, Will & Emery

[57] ABSTRACT

A movable contact element for a panel switch, wherein the movable contact element is protected against contamination until the movable contact element is assembled with a fixed contact element to form the panel switch. The movable contact element use a dome shaped inverting action type diagram made of a metal plate having a spring property. The diaphragm is fitted within an opening in a film by adhesive tape fixed to a convex side of the diaphragm and an upper surface of the film. A protective film with adhesive is glued to the lower surface side of the film to cover the concave portion of the diaphragm so as to protect the movable contact. The protective film is peeled away from the movable contact just before the movable contact is positioned over a fixed contact element and affixed thereto to form the panel switch.

7 Claims, 8 Drawing Sheets

MOVABLE CONTACT ELEMENT FOR PANEL SWITCH AND METHOD OF MANUFACTURING PANEL SWITCH WITH MOVABLE CONTACT ELEMENT

BACKGROUND OF THE INVENTION

The present invention relates to a movable contact element for a panel switch used in a thin type operation panel or the like of an electronic appliance, and to a method of manufacturing a panel switch using a movable contact element.

A conventional example of movable contact element for a panel switch of this kind is disclosed in Japanese Laid-open Patent No. Hei 7-320591.

According to Japanese Laid-open Patent No. Hei 7-320591, as shown in an exploded perspective view in FIG. 5A and in a sectional view in FIG. 5B, a metal diaphragm 3, for use as a movable contact, is shown confronting a fixed contact 2 on a printed circuit board 1. The metal diaphragm 3 is inserted into the center of a hole 4A of a film 4 having holes 4A slightly larger than the metal diaphragm 3, and provided at the same positions as the fixed contacts 2. Adhesive tape 5, which is larger than the hole 4A, is placed over the convex side of the upper surface of the metal diaphragm 3 in contact with the film 4. The combination of the adhesive tape 5, metal diaphragm 3 and film 4 form a movable contact element 6 in the form of a sheet. The movable contact element 6 is laid over the printed circuit board 1 having the fixed contacts 2, thereby forming a panel switch.

However, the panel switch disclosed in Japanese Laid-open Patent No. Hei 7-320591 has a disadvantage. In particular, when mounting such a panel switch on a printed circuit board of the appliance, adequate space is needed for connecting the printed circuit board 1 of the switch to the printed circuit board of the appliance. Moreover, the process for mounting the panel switch takes time.

In order to reduce the cost involved in mounting the panel switch and to save the space in the appliance required to mount the panel switch, the printed circuit board 1 can be provided with the fixed contacts 2 of panel switch and formed integrally with the printed circuit board of the appliance, without the movable contact element 6. During the process of assembling an appliance, the movable contact element 6 of the panel switch is prepared separately and combined with the printed circuit board 1 of the appliance, which includes the printed circuit board 1 and the fixed contact 2, to form a panel switch.

However, this process also has a disadvantage. Specifically, until the movable contact element 6 is combined with the printed circuit board of the appliance, the concave side of the metal diaphragm 3 as the movable contact is exposed to the environment. As a result, the contact surface of the metal diaphragm 3 may become soiled or stained with foreign matter, for example, during the storage or transportation of the movable contact element 6, which in turn may possibly lead to contact failure.

SUMMARY OF THE INVENTION

The invention is devised to solve such conventional problems. The present invention is directed at a movable contact element for a panel switch, which is capable of preventing the contact element from becoming contaminated by protecting the contact element during storage and transportation. It is an object of the present invention to protect the movable contact element until the contact element is combined with the fixed contact. It is also an object of the present invention to disclose a method of manufacturing a panel switch with a movable contact element using a process for protecting the movable contact element from becoming contaminated prior to being assembled with a fixed contact.

To solve the problems pointed out above, the present invention prevents the contact of a metal diaphragm from being exposed. Specifically, a film is used to cover the concave side of the metal diaphragm, thereby protecting the hole in which the metal diaphragm is inserted as a movable contact of the movable contact element.

Accordingly, the contact portion of the movable contact element is protected during storage and transportation, and any decline in the reliability of the panel switch using the movable contact element may be prevented.

The present invention provides a movable contact element for panel switch comprising: a dome shaped inverting action type of movable contact made of a metal plate having a spring property, a film forming an accommodating portion by opening a penetration hole in which the movable contact is fitted; an adhesive tape for adhering and fixing the movable contact, which has been inserted from the upper surface side of the accommodating portion of the film into the penetration hole, to the movable contact and the film; and a protective film, which has adhesive, glued to the lower surface side of the film, to plug or cover the lower surface side of the accommodating portion of the film so as to protect the movable contact. As a result, the protective film with adhesive is adhered to the film to cover the hole in the film from the lower surface side of the movable contact and to protect the movable contact element during storage or transportation. The present invention provides the advantage of preventing the surface of the contact from becoming soiled because dust, fiber chips or other foreign matter is kept from invading the contact area. Moreover since the protective film is provided with adhesive, foreign matter that is in the environment before the protective film is glued to the film, sticks to the adhesive, and is prevented from becoming deposited on the contact surface of the movable contact element.

In another aspect of the present invention, the film containing an opening for accommodating a movable diaphragm may be glued to a separator and the holes for the movable diaphragms formed by a punching process performed after gluing the film and separator with adhesive into one body. The holes or openings are formed in both the film and the separator. Then a protective film with adhesive is glued to the lower surface side of the separator for protecting the movable diaphragm and to form a movable contact element. Next, when the movable contact element is ready for to be assembled into a panel switch, the protective film and separator are peeled from the film with the movable diaphragms and the film is overlaid and glued to a substrate having the fixed contacts. In this aspect of the present invention, the adhesive is not exposed to the surface of the die use to punch the openings in the film and the separator, so that the waste can be treated easily.

According to the present invention, the protective film with adhesive used for protecting the movable contact is a flexible resin film. Such a film does not produce fiber chips, unlike paper or the like, so that the possibility of depositing foreign matter while handling the movable contact is low.

A panel switch according to the present invention can be assembled by a manufacturing method, using a movable contact element having a movable diaphragm positioned within an opening in a film by adhesive tape attached to one side of the film and protected by a protective film attached to the other side of the film, and using a fixed contact provided on a substrate, wherein the panel switch is formed by peeling off the protective film from the movable contact element and by overlaying and affixing the movable contact element on the fixed contact provided on a substrate in a state of the movable contact. In this process the assembly of the panel switch is easy, resulting in a panel switch that is of high precision and high reliability, one that may be manufactured at low cost.

The invention itself, together with further objects and attendant advantages, will best be understood by reference to the following detailed description taken in conjunction with the accompanying figures.

DESCRIPTION OF THE PREFERRED EMBODIMENTS

Preferred embodiments of the invention are described below by referring to FIG. 1 to FIG. 4.

Figure 5A:
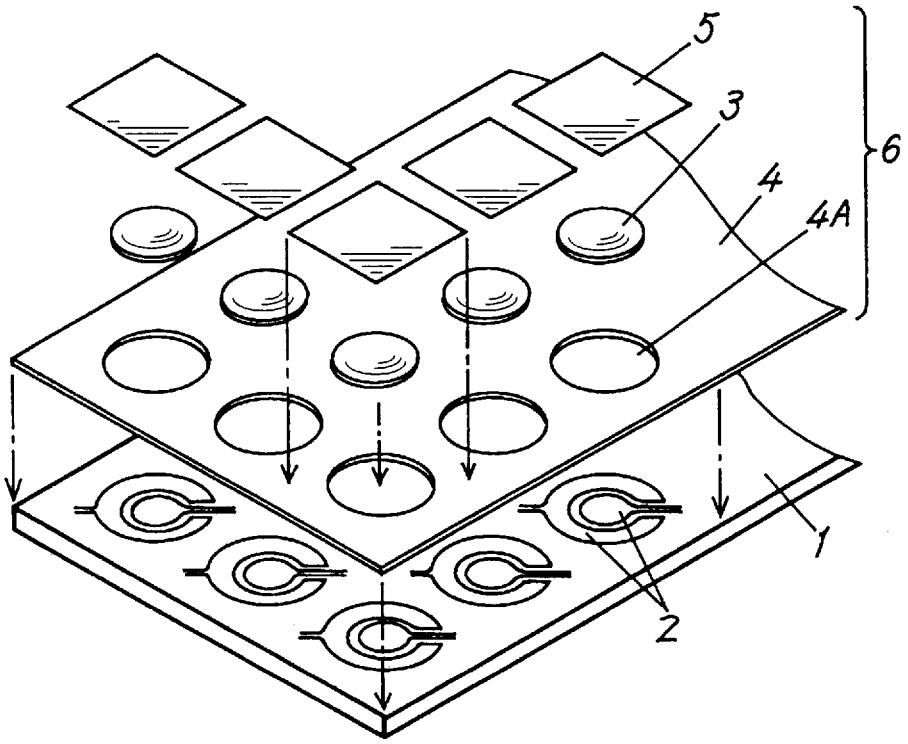
FIG. 5A (PRIOR ART)
FIG. 5A is an exploded perspective view of a conventional panel switch.
Figure 5B:
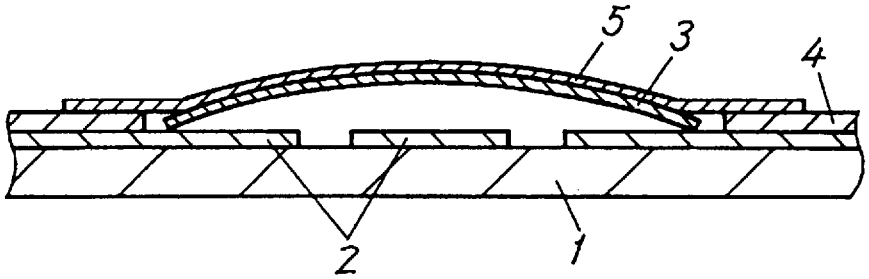
FIG. 5B (PRIOR ART)
FIG. 5B is a sectional view of FIG. 5A.

In the embodiments, the same constituent parts, as depicted in FIGS. 5A and 5B, are identified with the same reference numerals, and their description is omitted.

First Embodiment

Figure 1A:
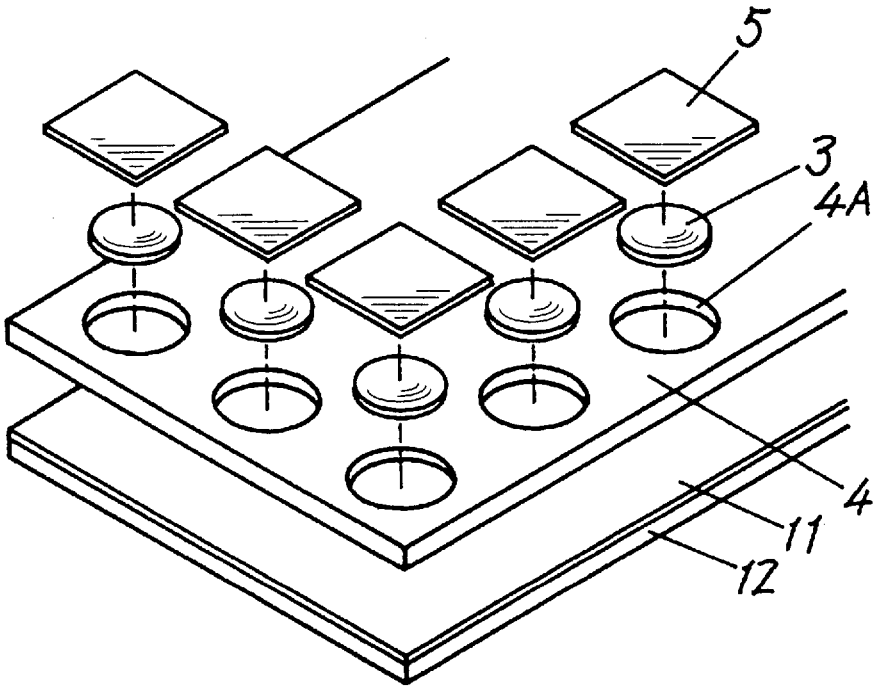
FIG. 1A is an exploded perspective view of a movable contact element for a panel switch according to a first embodiment of the invention.
Figure 1B:
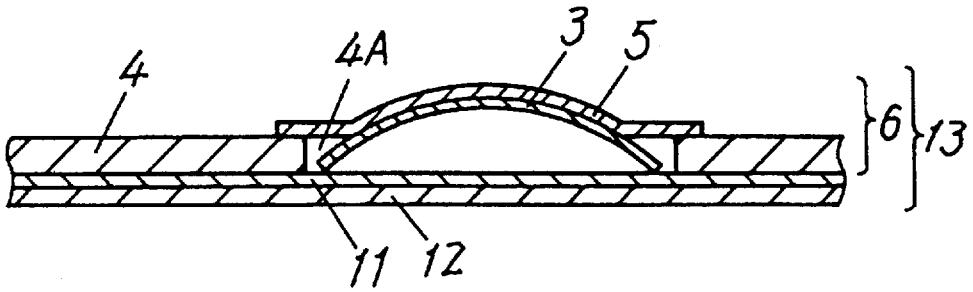
FIG. 1B is a sectional view of FIG. 1A.

FIG. 1A and FIG. 1B show a movable contact element for a panel switch according to a first embodiment of the invention. A metal diaphragm 3 is made of a metal plate having a spring property and is shaped like a dome. The metal diaphragm 3 is used as a movable contact of the inverting action type. A film 4 has a hole 4A slightly larger than the metal diaphragm 3. The metal diaphragm 3 is inserted into this hole 4A, and is affixed within the hole 4A of the film 4 by an adhesive tape 5, which is larger than the hole 4A. The adhesive tape 5 is glued to the upper surface of the film 4 and to the convex side of the metal diaphragm 3. In this manner, a movable contact element 6 is formed. Specifically, the film 4 is provided with penetration holes 4A for accommodating the metal diaphragms 3 for use the movable contacts.

Next, to prevent a metal diaphragm 3 from becoming contaminated with foreign matter deposited on the metal diaphragm 3, which is used as a movable element for making contact with a fixed contact, a protective film 12 is glued to the concave side of the metal diaphragm 3 with an adhesive 11. In this way, the lower side of movable contact element 6 is covered with a protective film 12 to form movable contact element 13.

The protective film 12 is made of resin, such as polyethylene terephthalate or polyethylene, with a thickness of, preferably, 25 to 125 microns, and it is flexible.

Figure 2:
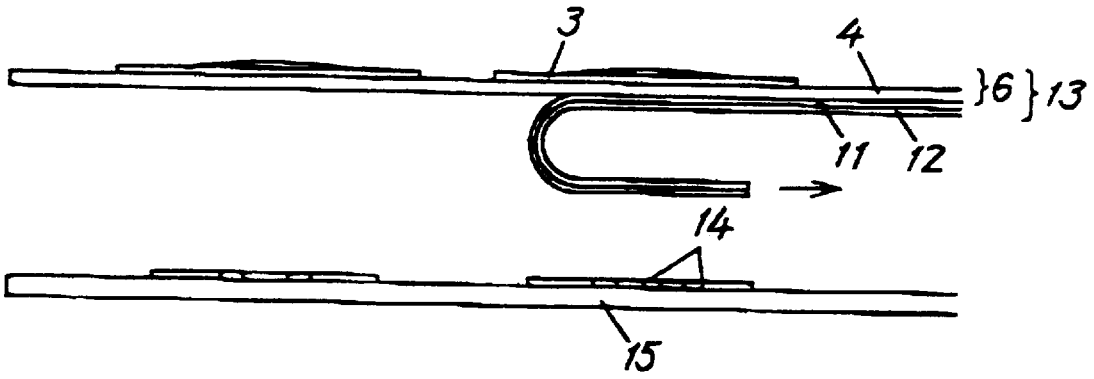
FIG. 2 is a side view useful for explaining the method of overlaying the movable contact element on a substrate having a fixed contact.

Next, the process of assembling the movable contact element 13 in an appliance having a fixed contact 14 on a printed circuit board 15 is described. with reference to FIG. 2. Just before overlaying the movable contact element 13 in an appliance having a fixed contact 14 on a printed circuit board 15, the protective film 12 is peeled off to expose the movable contact element 6, including the concave side of the metal diaphragm 3. Then, the metal diaphragm 3 is positioned over the fixed contact 14 of the printed circuit board 15, and the movable contact element 6 is affixed to the printed circuit board 15, thereby completing the assembly of the panel switch.

By using an adhesive having a slight adhesion characteristic as the adhesive 11 for the protective film 12, the film 12 can be peeled off easily from the movable contact element 6.

Second Embodiment

Figure 3A:
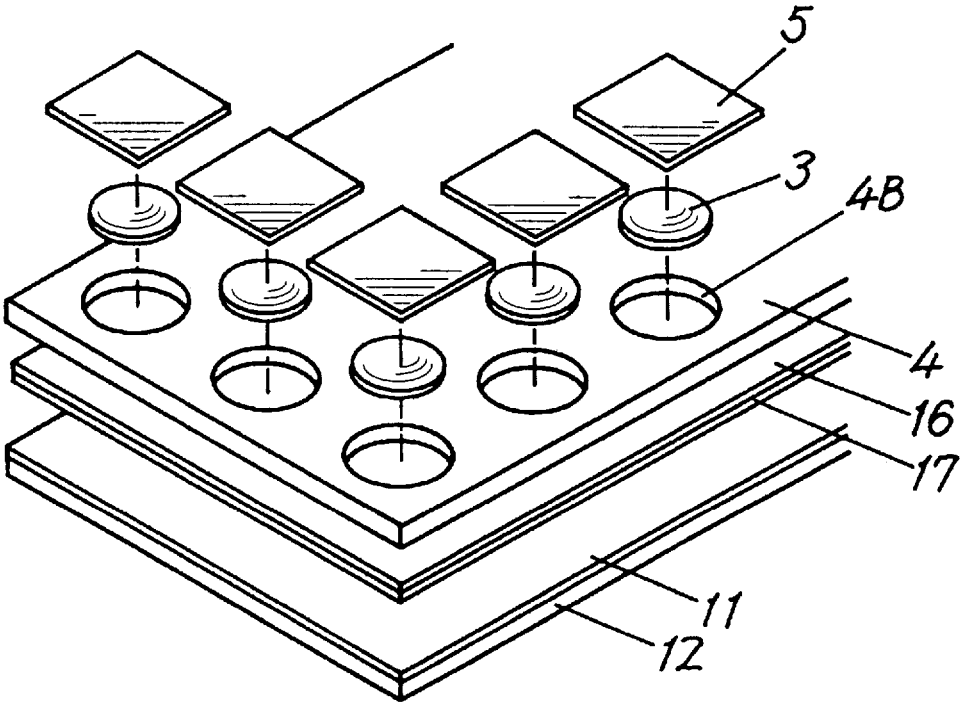
FIG. 3A is an exploded perspective view of a movable contact element for a panel switch according to a second embodiment of the invention.
Figure 3B:
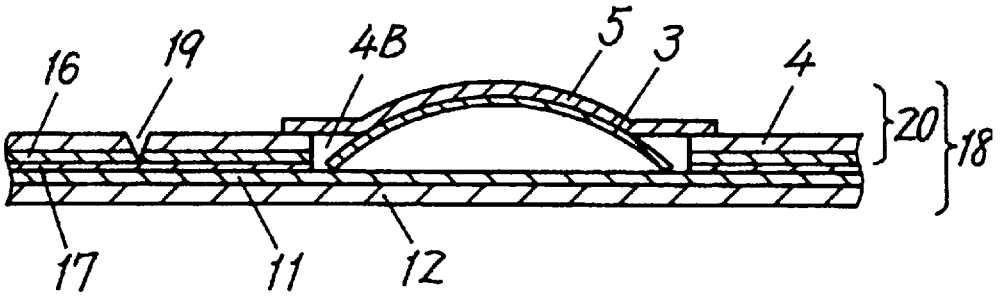
FIG. 3B is a sectional view of FIG. 3A.

FIG. 3A and FIG. 3B show a movable contact element for a panel switch according to a second embodiment of the invention. In this embodiment, a separator 17 is glued with an adhesive 16 to the back side of a film 4 in a manner that permits the separator 17 to be parted from the film 4 at a later time. A hole 4B for accommodating the metal diaphragm 3 is formed by penetrating or punching through both the film 4 and the separator 17.

This separator 17 is affixed to a side of the resin film 4 with adhesive 16. The hole 4B for accommodating the metal diaphragm 3 is formed by punching simultaneously through the film 4 and the separator 17 after gluing the film 4 and separator 17 together with the adhesive 16. The adhesive 16 is sandwiched between the film 4 and the separator 17, and hence, does not have an exposed surface.

In the punching process, since the adhesive 16 is sandwiched between the film 4 and the separator 17, the die use to punch the holes 4B does not readily accumulate deposits of adhesive 16. As a result, the frequency of die maintenance is reduced. Also, waste treatment is easy because the adhesive 16 is not exposed to the surface of the punching waste.

Consequently, as shown in FIG. 3A and FIG. 3B, to prevent the contamination of the movable diaphragm 3 by the deposit of foreign matter on the metal diaphragm 3, a protective film 12 is glued to the back side of the separator 17 with an adhesive 11. In this manner, a movable contact element 18 having a protective film 12 to protect the movable diaphragm 3 is formed.

Figure 4:
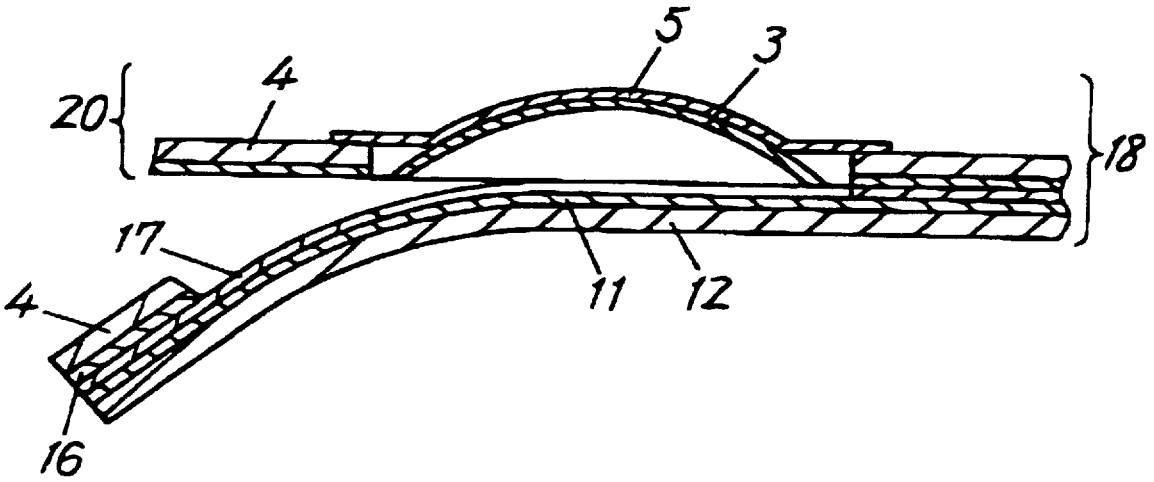
FIG. 4 is a sectional view useful for explaining the method of peeling off the protective film glued to the movable contact element.

Next, the process of assembling the movable contact element 18 in an appliance having a fixed contact 14 on a printed circuit board 15 is described. with reference to FIG. 4. Just before overlaying the movable contact element 18 in an appliance having a fixed contact 14 on a printed circuit board 15, the protective film 12 is peeled off together with the separator 17 of the movable contact element 18, thereby exposing the movable contact element 20, including the concave side of the metal diaphragm 3. Then, the metal diaphragm 3 is positioned over the fixed contact 14 of the printed circuit board 15, and the movable contact element 20 is affixed to the printed circuit board 15 by the adhesive 16, thereby completing the assembly of the panel switch.

Since the upper surface of the separator 17 is treated for parting as mentioned above, it is easily separated from the adhesive 16. Moreover, as shown in FIG. 3B, by forming a half cut 19 in the upper surface of the film 4 (to the adhesive 16), as shown in FIG. 4, the protective film 12 with the adhesive 11 can be easily peeled off together with the separator 17 as one piece.

Thus, according to the present invention, the movable contact element of a panel switch is prepared separately and protected from contamination. Then when the time comes to form a complete panel switch, the protective portion of the movable contact element is removed and the remaining movable contact element is combined with a printed circuit board of, for example, an appliance having the fixed contact during the appliance assembling process. As a result, contamination or the deposit of foreign matter on the movable contact can be prevented during storage and transportation of the movable contact element. The present invention has the advantage of providing a reliable movable contact element.

As pointed out above, the film 12 of the movable contact element for a panel switch is made of resin, such as polyethylene terephthalate or polyester, with a thickness of about 25 to about 125 microns. However, as a variation, other material can be used as far as it is flexible, and the invention may be also realized in other various modifications.

Of course, it should be understood that a wide range of changes and modifications can be made to the preferred embodiment described above and that the foregoing description be regarded as illustrative rather than limiting. It is therefore intended that it is the following claims, including all equivalents, which are intended to define the scope of this invention.

What is claimed is:

1. A movable contact element for panel switch comprising, at least one dome-shaped movable contact;

a film having at least one opening into which said movable contact is inserted;

adhesive tape adhering to a convex side of said movable contact inserted into said opening of the film and fixed to a surface of the film; and a protective film with adhesive glued to a surface of the film opposite to the surface to which the adhesive tape is affixed for temporarily covering a concave side of the movable contact, wherein the movable contact is protected from contamination, and wherein the protective film can be removed when the movable contact element is ready to be combined with structure having at least one fixed contact element to form said panel switch.

2. The movable contact element of claim 1, wherein the film with the at least one opening further includes, a separator affixed to the surface of the film with at least one opening opposite to the surface to which the adhesive tape is affixed, wherein the openings in the separator are formed simultaneously with the openings in the film after the separator is affixed to the film, and wherein said separator can be removed from the film with at least one opening at the same time when said protective film is removed.

3. The movable contact element of claim 1, wherein the protective film is a flexible resin film.

4. A method of manufacturing a movable contact element, comprising the steps of:

forming at least one opening in a film;

inserting a dome-shaped movable contact into said opening in the film;

affixing said dome-shaped movable contact within said opening in the film by taping a convex side of said dome-shaped movable contact to a surface of the film; and attaching a protective film to a surface of the film opposite to the surface to which said dome-shaped movable contact is affixed for temporarily covering a concave side of said movable contact, wherein said movable contact is protected from contamination, and wherein the attached protective film can be removed when the movable contact element is ready to be combined with structure having at least one fixed contact element to form a panel switch.

5. The method of manufacturing a movable contact element of claim 4, wherein the step of forming at least one opening in a film includes the additional steps of:

affixing a separator to the film; and forming at least one opening in the separator at the same time that said at least one opening is formed in the film.

6. A method of manufacturing a panel switch having a movable contact element, comprising the steps of:

forming at least one opening in a film;

inserting a dome-shaped movable contact into said opening in the film;

affixing said dome-shaped movable contact within said opening in the film by taping a convex side of said dome-shaped movable contact to a surface of the film to form said movable contact element;

attaching a protective film to a surface of the film opposite to the surface to which said dome-shaped movable contact is affixed for temporarily covering a concave side of said movable contact;

removing the protective film from the film with at least one opening just prior to affixing the movable contact element to structure having at least one fixed contact; and affixing the movable contact element to said structure having said at least one fixed contact to form said panel switch, wherein said movable contact is protected from contamination while awaiting assembly as part of said panel switch.

7. The method of manufacturing a panel switch of claim 6, wherein the step of forming at least one opening in a film includes the additional steps of:

affixing a separator to the film;

forming at least one opening in the separator at the same time that said at least one opening is formed in the film; and wherein the step of removing the protective film from the film with at least one opening just prior to affixing the movable contact element to said structure having said at least one fixed contact includes removal of the separator simultaneously with the protective film.

* * * * *